US010945541B2

(12) United States Patent
Omoto et al.

(10) Patent No.: US 10,945,541 B2
(45) Date of Patent: Mar. 16, 2021

(54) TABLE

(71) Applicant: BIRDY PLAN Co., Ltd., Tokyo (JP)

(72) Inventors: Kiyoshi Omoto, Tokyo (JP); Anna Omoto, Tokyo (JP)

(73) Assignee: Birdy Plan Co., LTD

( * ) Notice: Subject to any disclaimer, the term of this patent is extended or adjusted under 35 U.S.C. 154(b) by 0 days.

(21) Appl. No.: 16/619,340

(22) PCT Filed: Feb. 14, 2019

(86) PCT No.: PCT/JP2019/005231
§ 371 (c)(1),
(2) Date: Dec. 4, 2019

(87) PCT Pub. No.: WO2020/044598
PCT Pub. Date: Mar. 5, 2020

(65) Prior Publication Data

US 2020/0383502 A1 Dec. 10, 2020

(30) Foreign Application Priority Data

Aug. 30, 2018 (JP) ..... 2018-161061

(51) Int. Cl.

| | |
|---|---|
| ***A47G 7/04*** | (2006.01) |
| ***A47B 88/477*** | (2017.01) |
| ***A47B 13/12*** | (2006.01) |
| ***A47G 7/00*** | (2006.01) |

(52) U.S. Cl.
CPC ..... *A47G 7/041* (2013.01); *A47B 13/12* (2013.01); *A47B 88/477* (2017.01); *A47G 7/006* (2013.01)

(58) Field of Classification Search
CPC ..... A47G 7/041; A47G 7/006; A47B 13/12; A47B 88/477
See application file for complete search history.

(56) References Cited

U.S. PATENT DOCUMENTS

| | | | | |
|---|---|---|---|---|
| 3,110,532 A | | 11/1963 | Nail | |
| 4,551,943 A | * | 11/1985 | Pas | A47G 7/041 47/39 |
| 4,597,221 A | * | 7/1986 | Adair | A01G 9/02 47/66.6 |
| 5,066,078 A | * | 11/1991 | Wurst | A47B 13/12 312/114 |

(Continued)

FOREIGN PATENT DOCUMENTS

| | | |
|---|---|---|
| JP | 60-182843 | 12/1985 |
| JP | 3026277 | 7/1996 |
| JP | 10-216033 | 8/1998 |

*Primary Examiner* — Hanh V Tran
(74) *Attorney, Agent, or Firm* — Jack Schwartz & Associates, PLLC

(57) ABSTRACT

A table to maintain conditions of the preserved flower for a longer time is to be provided. For solving the problem, a table is provided which has a top board portion and a support portion to support the top board portion, wherein the top board portion includes a case with at least two first vents on a base and an opening upper surface, a fixing material contained in the case and having second vents connected to the first vents, a preserved flower F inserted into the fixing material 9 and contained in the case, and a transparent plane plate arranged to cover the upper surface of the case.

13 Claims, 6 Drawing Sheets

(56) References Cited

U.S. PATENT DOCUMENTS

| | | | | |
|---|---|---|---|---|
| 6,862,843 | B2 * | 3/2005 | Missry | A01G 13/0212 47/65.5 |
| 2002/0159246 | A1 * | 10/2002 | Murasko | G09F 13/04 362/84 |
| 2003/0071545 | A1 * | 4/2003 | Fink | A47F 3/005 312/114 |
| 2005/0193606 | A1 * | 9/2005 | Stangl | A47B 13/12 40/606.08 |
| 2006/0000393 | A1 * | 1/2006 | Ka'ahumanu | A47B 13/12 108/25 |
| 2009/0050028 | A1 * | 2/2009 | Liao Fang | A47B 13/12 108/26 |
| 2015/0033606 | A1 * | 2/2015 | Dinlocker | A47G 1/14 40/727 |
| 2016/0058206 | A1 * | 3/2016 | Schwalbach | H02J 7/0042 361/752 |
| 2017/0360191 | A1 * | 12/2017 | Jaramillo | B32B 15/18 |
| 2019/0357669 | A1 * | 11/2019 | Wang | F21V 19/003 |

* cited by examiner

TABLE

TECHNICAL FIELD

The present invention relates to tables.

BACKGROUND ART

Known is a preserved flower which retains such a texture and a shape as those of a fresh flower for a longer period than the fresh flower by substituting water content of the fresh flower with a preservative liquid. A container to display the preserved flower is also devised until now, for example as shown in the following patent document 1.

As described in the paragraph [0020] of it, the container for a preserved flower ornament shown in the patent document 1 contains a desiccant 25 internally. The container has a configuration to cut off an inflow of humidity from the outside with sealants 60 applicated at the fitting portion 11 and the fitting portion 21, namely, at a clearance between the transparent container 10 and the saucer for ornament 20, and at a clearance between the saucer-stand 23 and the drying portion 24 respectively.

It should be noted that in the paragraph, we can see descriptions that we should peel the bound sealant off for separating the transparent container 10 and the saucer for ornament 20, and we should peel the bound sealant 60 off for exchanging the drying portion 24.

RELATED ART DOCUMENT

Patent Document patent document 1: Japanese Unexamined Patent Application Publication No. 2007-44451

SUMMARY OF THE INVENTION

Problems to be Solved by the Invention

There is a problem that the preserved flower has weakness to drying because of such a reason that the petal cracks when it dries. There is another problem that it takes much time to peel the sealant applied as stated above off and to apply the sealant again after the end of the work in case that it is necessary to revise the inside of a container.

A subject of the present invention is to provide a table which can maintain conditions of the preserved flower for a longer time, for solving the above problems.

Means of Solving the Problems

For solving the above problems, the present invention provides a table including a top board portion and a support portion to support the top board portion, wherein the top board portion includes a case with at least two first vents on a base and an opening upper surface, a fixing material contained in the case and having second vents connected to the first vents, a preserved flower inserted into the fixing material and contained in the case, and a transparent plane plate arranged to cover the upper surface of the case.

And, for solving the above problems, the present invention provides a table including a top board portion and a support portion to support the top board portion, wherein the top board portion includes a transparent plane plate, an underframe joined to the support portion, a frame bonded to a periphery of the plane plate and fitted to the underframe, a fixing material contained in the underframe, a preserved flower inserted into the fixing material and contained in the underframe, and a lock portion to engage the frame with the underframe detachably.

And, for solving the above problems, the present invention provides a table including a top board portion and a support portion to support the top board portion, wherein the top board portion includes a transparent plane plate, an outer frame solid bonded to a periphery of the plane plate and joined to the support portion in the base, a drawer that can slide into and out of the outer frame solid, an intermediate layer laid on a base inside the drawer, a fixing material laid on said intermediate layer, a preserved flower inserted in the fixing material and contained in the drawer, and a lock portion to engage the drawer with the outer frame solid detachably.

Effects of the Invention

With the present invention, a table can be provided to maintain conditions of the preserved flower for a longer time.

BRIEF DESCRIPTION OF THE DRAWINGS

FIG. 4A is a sectional view to show a locked state of the lock portion 5 shown in

FIG. 3;

MODES FOR CARRYING OUT THE INVENTION

Figure 1:
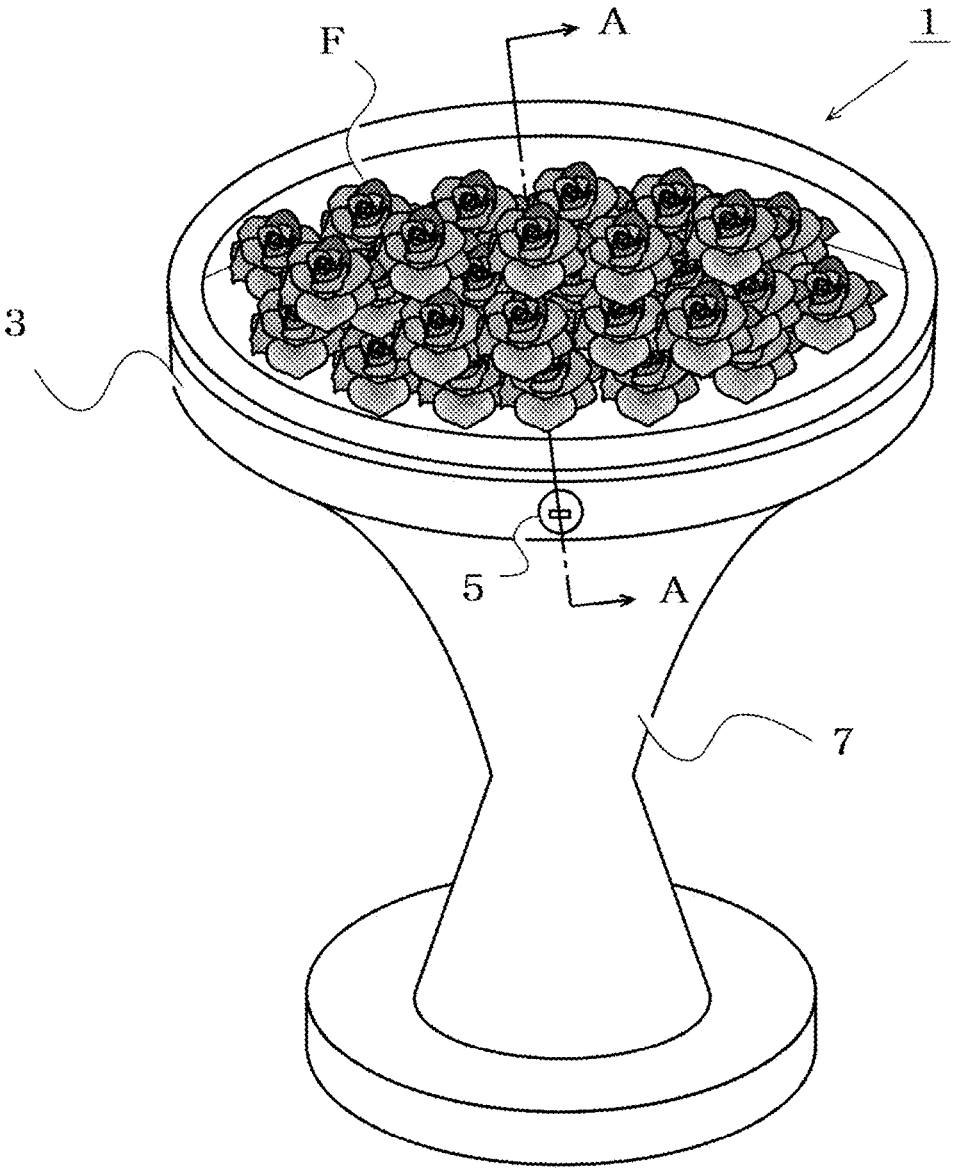
FIG. 1 is an oblique projection view showing a whole structure of the table 1 in accordance with the first embodiment of the present invention.

Hereinafter, the embodiments of the present invention are explained in detail referring to the drawings. It should be noted that identical symbols in the drawings show the same or a similar portion.

First Embodiment

FIG. 1 is an oblique projection view showing a whole structure of the table 1 in accordance with the first embodiment of the present invention. As shown in FIG. 1, the table 1 in accordance with the first embodiment of the present invention includes the top board portion 3, which has the lock portion 5 and contains the preserved flower F etc., and the support portion 7 to support the top board portion 3.

It should be noted that a planar shape of the top board portion 3 shown in FIG. 1 is not only a circle but also other shapes such as a rectangle and so on. It goes without saying that the support portion 7 might have any design only if it can support the top board portion 3 and be placed on a floor and so on.

Figure 2:
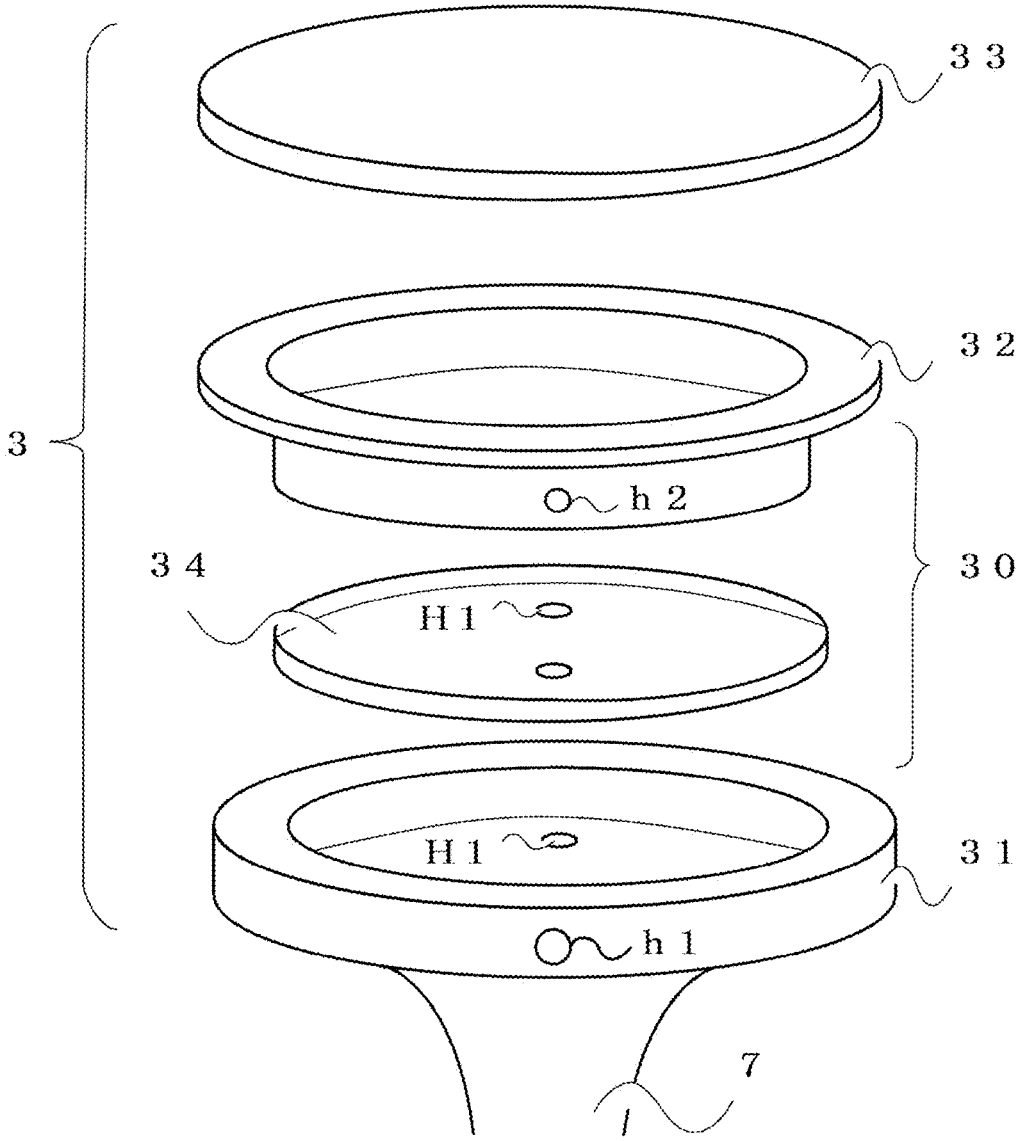
FIG. 2 is an oblique projection view for explaining a structure of the top board portion 3 shown in FIG. 1.

FIG. 2 is an oblique projection view for explaining a structure of the top board portion 3 shown in FIG. 1. As shown in FIG. 2, the top board portion 3 includes the case 30 with an opening upper surface and the plane plate 33 such as a transparent glass arranged as covering the upper surface of the case 30.

The case 30 has a cylindrical internal void with an opening upper portion on a circular base and is composed of the underframe 31 made of material such as wood, the intermediate layer 34 such as a thick paper laid on the base, and the frame 32, bonded to a periphery of the plane plate 33, such as metal fitted to the underframe 31 under a state of pinching the intermediate layer 34 from the top of it.

The base of the underframe 31 joins the support portion 7 and has the first vent H1 below. The side of the underframe 31 has the hole h1.

The base of the intermediate layer 34 has a vent connected to the first vent H1, the size of which is the same as that of the first vent H1.

The frame 32 is an annular solid with the hole h2 in the side and without a base. It is inscribed inside the internal void of the underframe 31 under a state of pinching the intermediate layer 34 and fitted to the underframe 31 so that the hole h2 is connected to the hole h1.

Figure 3:
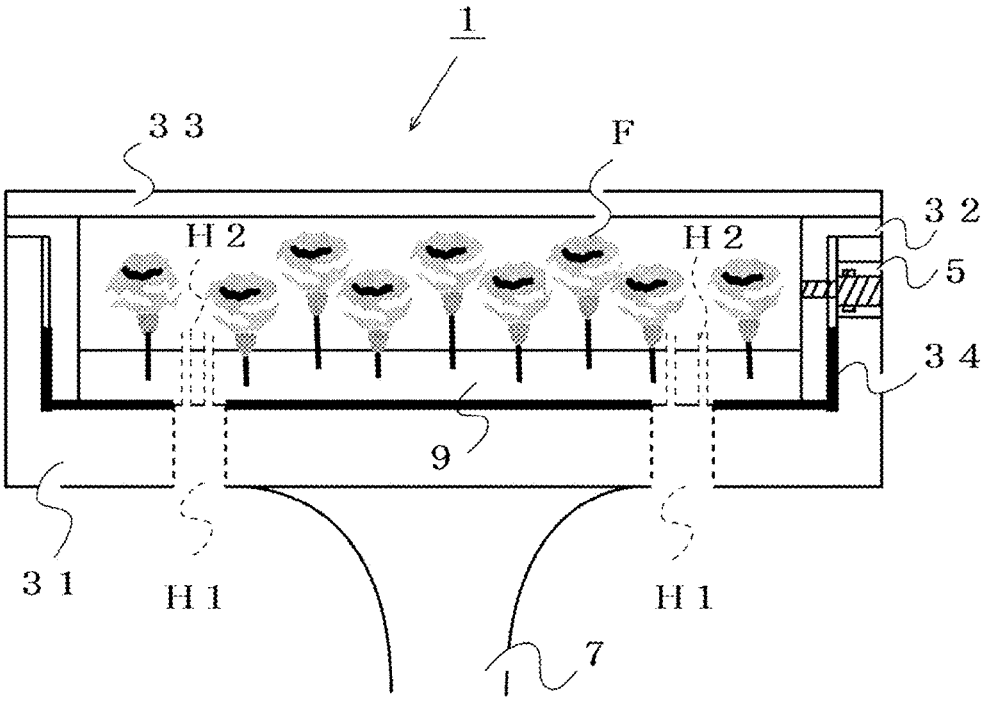
FIG. 3 is a sectional view showing a sectional structure along the A-A line on the top board portion 3 shown in FIG. 1.

FIG. 3 is a sectional view showing a sectional structure along the A-A line on the top board portion 3 shown in FIG. 1. As shown in FIG. 3, the base of the underframe 31 has at least the two first vents H1. The intermediate layer 34 with a vent connected to the first vent H1 and having the same size as that of the first vent H1 is laid on the base of the underframe 31.

The oasis 9 such as urethane resin with the second vent H2 connected to the first vent H1 is placed on the intermediate layer 34 and fixed. The oasis 9 has a function as a fixing material that fixes the preserved flower, so that the preserved flower F is inserted in the oasis 9.

It should be noted that the intermediate layer 34 would be preferable if the oasis 9 and the preserved flower F were exchanged in a lump because the oasis 9 and the preserved flower F thereon can be taken out easily by lifting the intermediate layer 34.

The first vents H1 in the bases of the underframe 31 and the intermediate layer 34 are located, for example, at two positions that form point symmetry around a center of the base. The number and the positions of the first vents H1 are not limited above.

Since the permeability of the internal void surrounded with the plane plate 33 and the case 30 which consists of the underframe 31, the intermediate layer 34, and the frame 32 is secured by forming the first and the second vents H1,H2, the preserved flower can be protected against the humidity generally known as a weakness thereof.

It should be noted that the second vent H2 is a vent formed in the oasis 9, so that the preserved flower F cannot be inserted there for the permeability. Therefore, it is preferable that a diameter of the second vent H2 is big in view of the permeability. However, the preserved flowers F cannot be arranged uniformly on the oasis 9 in case that the diameter of the second vent H2 has an identical size to that of the first vent H1. Then it is preferable that the second vent H2 has a smaller diameter than that of the first vent H1.

An example that two second vents H2 are formed per one first vent H1 is shown in FIG. 3. But the number of the second vent H2 is not limited to this.

As shown in FIG. 3, the lock portion 5 to engage the frame 32 with the underframe 31 detachably is arranged inside the side of the underframe 31. Hereinafter the lock portion 5 is explained in detail referring to FIG. 4A and FIG. 4B.

It should be noted that the lock portion 5 may consist of any type of lock. A case to use commercially available push-type lock is explained as an example below.

Figure 4A:
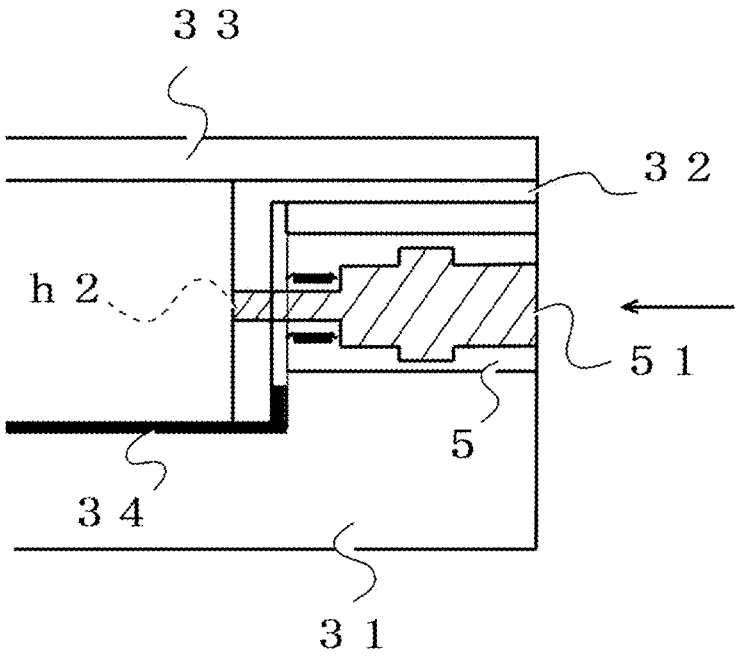
Figure 4B:
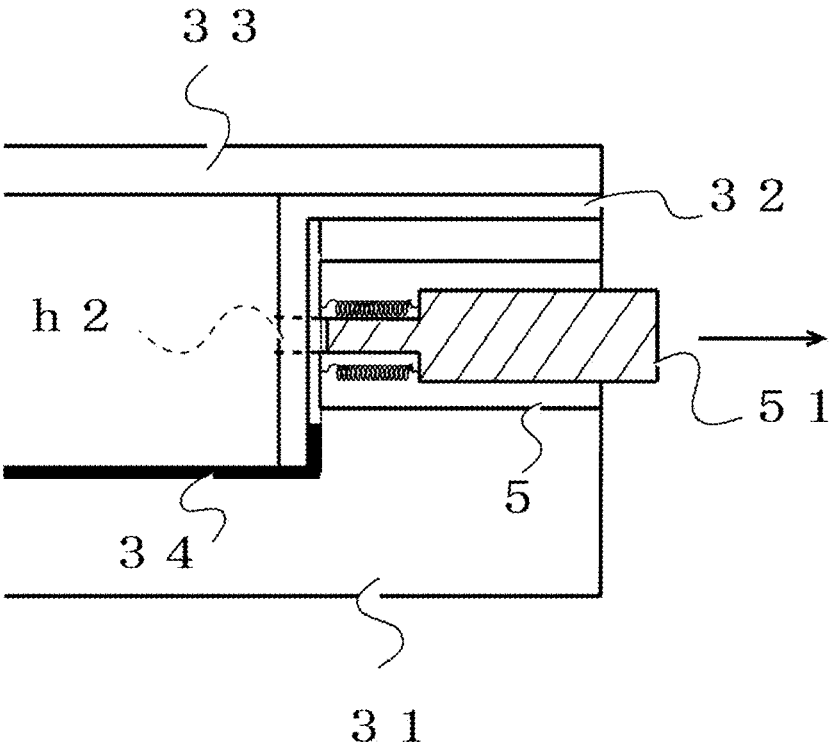
FIG. 4B is a sectional view to show an unlocked state of the lock portion 5 shown in FIG. 3.

FIG. 4A and FIG. 4B are diagrams for explaining the operation of the lock portion 5 shown in FIG. 3, which are sectional views to show locked and unlocked states respectively.

The lock portion 5 is arranged in the hole h1 formed on a side of the underframe 31 shown in FIG. 2, being composed of the inner casing portion 51 shown with oblique lines and the outer casing portion outside the inner casing portion 51. The lock portion 5 detachably engages the frame 32 with the underframe 31 in the following way.

In the locked state, as shown in FIG. 4A, the frame 32 is fixed to the underframe 31 since the inner casing portion 51 is locked to the outer casing portion by staying through the hole h2 formed in the frame 32.

As shown in FIG. 4B, the inner casing portion 51, which becomes unlocked to the outer casing portion, moves outside the hole h2 in the arrow direction when a user inserts a key in the arrow direction of FIG. 4A and rotates it. Thus, the frame 32 goes into a state that it can be separated from the underframe 31.

Therefore, the above lock portion 5 can certainly protect the preserved flower F against dust in the air, the wind, and a human touch generally known as a weakness of the preserved flower by the lock when the table 1 is used. And, the lock portion 5 can secure safety needed as a table because it realizes a crime prevention function to prevent playing a prank on the contents, and an unusual object such as a cigarette from being mixed into the internal void.

On the other hand, since the frame 32 bonding the plane plate 33 can be separated upward from the underframe 31 by unlocking the lock, maintenance of the oasis 9 and the preserved flower F contained in the underframe 31 can be performed easily.

It should be noted that the oasis 9 and the preserved flower F on the intermediate layer 34 can be easily taken out in a lump in case that the intermediate layer 34 is laid on the underframe 31 as stated above.

The lock portion 5 is arranged in the underframe 31 in view of design. However, it goes without saying that the lock portion 5 is not always necessarily arranged inside the underframe 31.

From the above, according to the table 1 as the first embodiment of the present invention, conditions of the preserved flower F can be maintained for longer time because the permeability of the void where the preserved flower F is placed can be secured by forming the first vent H1 in the underframe 31 and the intermediate layer 34, and the second vent H2 in the oasis 9 respectively.

Also, according to the table 1, the safety as a table is secured with the preserved flower F being certainly protected against a human touch and so on as mentioned above by the locking, and the maintenance of the preserved flower F and the oasis 9 can be performed easily by the unlocking.

Second Embodiment

The table in accordance with the second embodiment of the present invention has a similar structure to that of the table 1 in accordance with the first embodiment, and there is only a different part in the structure of the top board portion 3. Therefore, explanations on the common parts are omitted below, and only the different points are explained.

Figure 5:
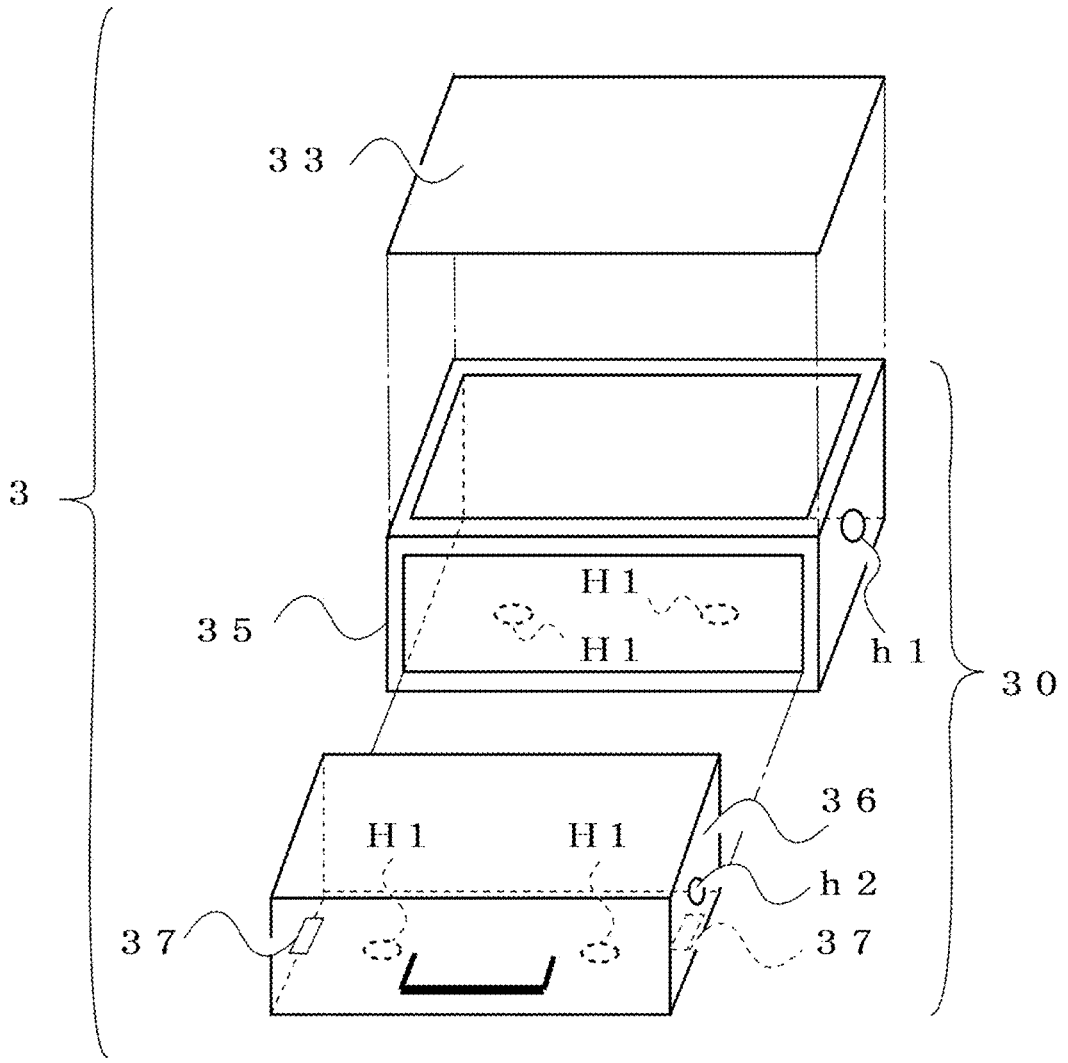
FIG. 5 is an oblique projection view for explaining a structure of the top board portion 3 of the table in accordance with the second embodiment of the present invention.

FIG. 5 is an oblique projection view for explaining a structure of the top board portion 3 of the table in accordance with the second embodiment of the present invention. As shown in FIG. 5, the case 30 that is an element of the table in accordance with the second embodiment includes the outer frame solid 35 joined at the base by the support portion 7, and the drawer 36 that can slide into and out of the outer frame solid 35 and has the first vent H1 on the base.

On the base inside the drawer 36, the first vent H1 is formed, and the intermediate layer 34 placing the fixing material 9 on it is laid. On the inner side of the drawer 36, arranged is the stopper 37 that stops movement in the vertical direction of the intermediate layer 34. It should be noted that the number and the position of the stopper 37 are not limited to the example shown in FIG. 5.

In a similar way to the table 1 in accordance with the first embodiment, the lock portion 5 to engage the drawer 36 with the outer frame solid 35 detachably is arranged inside the hole h1 formed in the frame of the outer frame solid 35.

According to the table as the above second embodiment of the present invention, effects similar to those of the table 1 as the first embodiment are caused. Furthermore, maintenance of the oasis 9 and the preserved flower F can be performed conveniently because the contents contained in the drawer 36 can be exchanged easily by pulling the drawer 36 out of the outer frame solid 35.

Also, according to the present table, it can be used for multiple purposes such as placing the oasis 9 and the preserved flower F on a part of the partitioned base as mentioned above and small articles etc. on other parts of the partitioned base by arranging a partition in the drawer 36.

DESCRIPTION OF THE REFERENCE NUMERAL

1 table, 3 top board portion, 5 lock portion, 7 support portion, 30 case, 31 underframe, 32 frame, 33 plane plate, 34 intermediate layer, 35 outer frame solid, 36 drawer, 37 stopper, F preserved flower, H1 first vent, H2 second vent

The invention claimed is:

1. A table comprising:

a top board portion; and a support portion to support said top board portion, wherein said top board portion includes a case with at least two first vents on a base and an opening upper surface, a fixing material contained in said case and having second vents connected to said first vents, a preserved flower inserted into said fixing material and contained in said case, and a transparent plane plate arranged to cover the upper surface of said case.

2. The table according to claim 1, wherein said first vents are two vents located at positions that form point symmetry around a center of said base.

3. The table according to claim 1, wherein each of said second vents has a smaller diameter than that of each of said first vents.

4. The table according to claim 1, wherein said case includes an underframe joined to said support portion, an intermediate layer laid on said underframe and having said first vents on the base, and a frame bonded to a periphery of said plane plate and fitted to said underframe so that said intermediate layer is pinched.

5. The table according to claim 1, wherein said case includes an outer frame solid bonded to a periphery of said plane plate, joined to said support portion in the base, and having said first vents in the base, and a drawer that can slide into and out of said outer frame solid and has said first vents on the base.

6. The table according to claim 5, wherein said case further includes an intermediate layer laid on a base inside said drawer, having said first vents, and placing said fixing material thereon, and said drawer includes a stopper arranged on an inner side to stop movement in the vertical direction of said intermediate layer.

7. The table according to claim 1, wherein said case includes an underframe joined to said support portion, and a frame bonded to a periphery of said plane plate and fitted to said underframe, and said top board portion further includes a lock portion to engage said frame with said underframe detachably.

8. The table according to claim 1, wherein said case includes an outer frame solid bonded to a periphery of said plane plate, joined to said support portion in the base, and having said first vents in the base, and a drawer that can slide into and out of said outer frame solid and has said first vents on the base, and said top board portion further includes a lock portion to engage said drawer with said outer frame solid detachably.

9. A table comprising:

a top board portion; and a support portion to support said top board portion, wherein said top board portion includes a transparent plane plate, an underframe joined to said support portion, a frame bonded to a periphery of said plane plate and fitted to said underframe, a lock portion to engage said frame with said underframe detachably, an intermediate layer laid on said underframe and pinched between said underframe and said frame, a fixing material placed on said intermediate layer, and a preserved flower inserted into said fixing material and contained in said underframe.

10. The table according to claim 9, wherein said lock portion is arranged in said underframe.

11. A table comprising:

a top board portion; and a support portion to support said top board portion, wherein said top board portion includes a transparent plane plate, an outer frame solid bonded to a periphery of said plane plate and joined to said support portion in the base, a drawer that can slide into and out of said outer frame solid, an intermediate layer laid on a base inside said drawer, a fixing material laid on said intermediate layer, a preserved flower inserted in said fixing material and contained in said drawer, and a lock portion to engage said drawer with said outer frame solid detachably.

12. The table according to claim 11, wherein said lock portion is arranged in the frame of said outer frame solid.

13. The table according to claim 11, wherein said drawer includes a stopper that is arranged on the inner side and stops movement in the vertical direction of said intermediate layer.

* * * * *